United States Patent [19]

Haslegrave et al.

[11] Patent Number: 4,515,708

[45] Date of Patent: May 7, 1985

[54] CORROSION INHIBITORS

[75] Inventors: John A. Haslegrave; Daniel S. Sullivan, both of Houston, Tex.

[73] Assignee: Exxon Research & Engineering Co., Florham Park, N.J.

[21] Appl. No.: 552,402

[22] Filed: Nov. 16, 1983

[30] Foreign Application Priority Data

Nov. 24, 1982 [GB] United Kingdom ..... 8233563

[51] Int. Cl.[3] ..... C09K 3/00

[52] U.S. Cl. ..... 252/390; 252/146; 252/148; 252/394

[58] Field of Search ..... 252/146, 148, 390, 394; 546/304, 314, 315, 316, 326, 329

[56] References Cited

U.S. PATENT DOCUMENTS

| | | | |
|---|---|---|---|
| 3,317,550 | 5/1967 | Cislak et al. | 252/148 |
| 3,352,870 | 11/1967 | Cislak et al. | 252/146 |
| 3,375,255 | 3/1968 | Cislak et al. | 252/148 |
| 3,410,861 | 11/1968 | McCloskey | 260/296 |

*Primary Examiner*—Paul Lieberman
*Assistant Examiner*—Hoa Van Le
*Attorney, Agent, or Firm*—Roland A. Dexter

[57] ABSTRACT

Corrosion inhibition of metals is obtained treating a system with a corrosion-inhibiting amount, preferably 1 to 10000 ppm, of an optionally-substituted β-pyridyl-ethylamine or a salt thereof, which may be prepared by reacting an amine with a vinylpyridine, preferably in the presence of an acidic catalyst such as acetic acid. The β-pyridyl-ethylamine is a compound of the general formula:

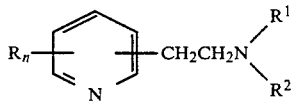

wherein R is an alkyl, aryl, aralkyl, alkaryl, halo or amino group of a group —COX where X is hydrogen, alkyl, aryl, hydroxy, alkoxy, aryloxy, amino or halo group, n is zero or an integer from 1 to 4, and $R^1$ and $R^2$, which may be the same or different, each represent a hydrogen atom, an optionally substituted hydrocarbyl radical, an alkylamino radical, a heterocyclic radical or a group

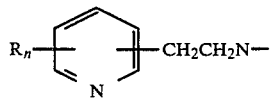

or $R^1$ and $R^2$ with the intervening nitrogen atom together represent a saturated or unsaturated heterocyclic ring optionally containing one or more additional heteroatoms.

8 Claims, No Drawings

CORROSION INHIBITORS

This invention relates to corrosion inhibitors, and in particular concerns certain amine adducts of vinyl pyridines with excellent corrosion inhibiting properties, particularly in protecting steel surfaces.

BACKGROUND OF THE INVENTION

Vinyl pyridines are known from the literature to react with amines to form the corresponding 2-animoethylpyridine derivatives. Doering and Weil, JACS, 1947, 69, 2461 describe the reaction of 2-vinylpyridine with diethylamine at high temperature to give low yields of α-diethylamino-β-(2-pyridyl)-ethane, and a similar reaction of 2-vinylpyridine with piperidine to yield N-β-(2-pyridyl)-ethylpiperidine. Magnus and Levine, JACS, 1956, 78, 4127, describe the reaction of 4-vinylpyridine and 2-methyl-5-vinyl-pyridine with various primary and secondary amines to form the corresponding pyridylethylated products and recommends the use of acetic acid or hydrogen chloride as condensing agent with secondary amines and the use of sodium metal as condensing agent when pyrrole is used as the amine. Phillips, JACS, 1956, 78, 4441 describes the preparation of various 4-(substituted aminoethyl)-pyridines by the addition of secondary and primary amines to 4-vinylpyridine, and suggests acid catalysis of the reaction. Chemical Abstracts, 51, 5074a describes condensation of 4-vinyl-pyridine and 2-methyl-6-vinylpyridine with 1–4 moles primary and secondary alkyl and aryl amines using acetic acid as catalyst.

German Pat. No. 2359107 describes the formation of 2-methylaminoethyl-pyridine, useful in treating circulatory diseases, from 2-vinylpyridine by reaction with $MeNH_2AcOH$ or $MeNH_2EtCO_2H$. Swiss Pat. No. 387993 describes the preparation of pharmaceutically-active N-substituted aminoethyl pyridines by reacting 2-(or 4-) vinyl alkyl pyridines with amines in the presence of $Co^{++}$ or $Cu^{++}$ with polyfunctional anion-exchangers. Swiss Pat. No. 367094 describes the pyridylethylation of N-containing heterocycles with vinylpyridines at elevated temperatures in an organic solvent containing a base, and reports treating heterocycles such as pyrrole, indole or carbazole with β-vinylpyridine in dimethylsulphoxide. U.S. Pat. No. 3,410,861 discloses the preparation of pharmaceutically-active β-(2- or 4-pyridyl alkyl)-amines by reaction of a lower alkyl primary amine addition salt with vinylpyridine in aqueous medium. There is no disclosure in this prior art of the use of the 2-aminoethyl-pyridine derivatives having corrosion inhibiting properties.

Various amines are known as a corrosion inhibitor. U.S. Pat. No. 3,976,593 describes lower monoalkyl, preferably $C_1$ and $C_2$ 2-substituted pyridines such as 2-ethylpyridine as examples of corrosion inhibiting amines.

SUMMARY OF THE INVENTION

It has now been found that certain substituted aminoethyl pyridines are very effective corrosion inhibitors. Thus this invention provides a method of inhibiting corrosion of metals, which method comprises treating a system where metals are susceptible to corrosion with a corrosion-inhibiting amount of substituted β-pyridylethylamine or a salt thereof. In a preferred mode this invention provides a method of inhibiting the corrosion of metals by treatment of the system containing said metals with at least the corrosion inhibiting amount of a β-pyridylethylamine of the general formula:

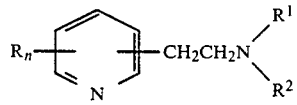

(I)

wherein R is an alkyl, aryl, aralkyl, alkaryl, halo or amino group or a group —COX where X is hydrogen, alkyl, aryl, hydroxy, alkoxy, aryloxy, amino or halo halo group, n is zero or an integer from 1 to 4, and $R^1$ and $R^2$, which may be the same or different, each represent a hydrogen atom, an optionally substituted hydrocarbyl radical, an alkylamino radical, a heterocyclic radical or a group

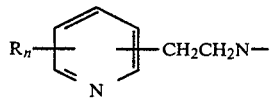

or $R^1$ and $R^2$ with the intervening nitrogen atom together represent a saturated or unsaturated heterocyclic ring optionally containing one or more additional heteroatoms.

DETAILED DESCRIPTION OF THE INVENTION

As recited above, this invention provides a method of inhibiting corrosion of metals, which method comprises treating a system where metals are susceptible to corrosion with a corrosion-inhibiting amount of an optionally substituted -pyridyl-ethylamine or a salt thereof.

The optionally substituted -pyridyl-ethylamine is preferably a compound of the general formula:

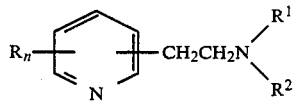

(I)

wherein R is an alkyl, aryl, aralkyl, alkaryl, halo or amino group or a group-COX where X is hydrogen, alkyl, aryl, hydroxy, alkoxy, aryloxy, amino or halo group, n is zero or an integer from 1 to 4, and $R^1$ and $R^2$, which may be the same or different, represent a hydrogen atom, an optionally substituted hydrocarbyl radical, an alkylamino radical, a heterocyclic radical or a group

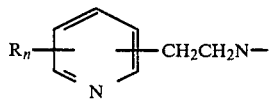

or $R^1$ and $R^2$ with the intervening nitrogen atom together represent a saturated or unsaturated heterocyclic ring optionally containing one or more additional heteroatoms.

Preferred hydrocarbyl radicals include straight or branched alkyl groups (preferably containing 1 to 30 carbon atoms) aryl groups (preferably containing from 6 to 14 carbon atoms) or aralkyl groups (preferably containing from 7 to 20 carbon atoms). When these hydrocarbyl groups are substituted they may bear one or more substituents preferably selected from non-polar groups such as alkyl groups, aryl groups and halogen atoms.

When $R^1$ or $R^2$ represents an alkylamino radical this is preferably a group of the formula:

$$(ANH)_mR^3$$

wherein A is an ethanediyl or propanediyl moiety, m is an integer of from 1 to 4 and $R^3$ is hydrogen or an alkyl group, preferably containing from 1 to 30 carbon atoms.

The method of this invention may also use salts of the compounds of general formula I. These salts may be formed with a mineral acid such as hydrochloric acid, with a carboxylic acid such as acetic acid, propionic acid or a long chain fatty acid such as tall oil fatty acid (TOFA) or dimerized and trimerized fatty acids, or with a sulphonic acid such as benzene sulphonic acid.

A most preferred group of corrosion-inhibiting compounds for use in the method of the invention are the compounds of the general formula:

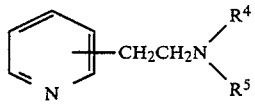

(II)

(wherein $R^4$ and $R^5$, which may be the same or different, each represent a hydrogen atom (provided that both $R^4$ and $R^5$ do not represent hydrogen), a straight or branched chain alkyl group containing from 1 to 22 carbon atoms, a benzyl group or an alkylamino group $-(A-NH)_m-R^3$; or $R^4$, $R^5$ and the intervening nitrogen atom to which they are bonded together form a piperidine, morpholine, pyridine or pyrrole radical) and salts thereof.

The 2-aminoethyl substituent may be attached to any of the available carbon atoms in the pyridine nucleus, but the 2- and 4-substituted pyridines are more preferred. Within general formula II highly preferred classes of compounds are the 2-(β-aminoethyl)- and 4-(β-aminoethyl)pyridines in which:

(a) $R^4$ represents hydrogen; and $R^5$ represent a benzyl group or a straight chain alkyl group having from 12 to 18 carbon atoms;

(b) $R^4$ represents

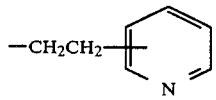

and $R^5$ represents a benzyl group or a straight chain alkyl group having from 12 to 18 carbon atoms;

(c) $R^4$ represents hydrogen; and $R^5$ represents a group $-A-NH-R^3$ and $R^3$ represents hydrogen or a straight chain alkyl group having from 12 to 18 carbon atoms;

(d) $R^4$ represents hydrogen; and $R^5$ represents $-(A-NH)_m-H$ and m is 2 or 3; and (e) $R^4$ and $R^5$ together represent $-(CH_2)_5-$ or $-(CH_2)_2-O-(CH_2)_2-$.

In each of these most preferred classes, the 2-substituted pyridine is preferred.

Specific most preferred compounds are described in the Examples.

Where a salt of the corrosion inhibiting compound is employed this is preferably an acetic salt, a tall oil fatty acid salt or a mixture of salts of both these acids.

The compounds used in the invention have shown high corrosion inhibition at relatively low concentrations. Thus it is possible to obtain significant inhibition of corrosion using the active materials at levels as low as 1 ppm (by weight) of the fluid(s) in the systems requiring protection. The optimum corrosion inhibiting amount for the active materials of the invention will depend, inter alia, upon the active material chosen, the metal(s) to be protected, the nature of the fluids having a corrosive tendency on these metals and the temperature and pressure within the system. However, by way of general indication, it may be said that the active material will generally be introduced into the system requiring protection at a concentration of from 1 to 10,000 ppm (by weight) of the fluid within the system, preferably at a concentration of 2 to 500 ppm, and for continuous injection applications most preferably at a concentration of 2 to 50 ppm. High concentrations (1000 to 10,000 ppm) may be desirable in batch treatments (such as is simulated in the film persistancy test) when it is preferable to use salts of the compounds of the invention formed with high molecular weight acids such as dimerized or trimerized fatty acids.

The active materials used in the invention will generally be handled in the form of a corrosion inhibiting composition comprising the active material and a suitable vehicle. The choice of vehicle will be affected by the particular application of the composition but will generally be selected from water and organic solvents such as hydrocarbons, alcohols, glycols and ethers. Isopropyl alcohol has been found a suitable general purpose carrier. The active material will generally comprise from 1 to 70 wt% of the composition. The composition may also contain other conventional additives such as preservatives, flow improvers, anti-freeze additives, biocides, fungicides, emulsion preventing agents, dispersing agents or additional corrosion inhibitors.

The substituted β-pyridyl-ethylamines used in the invention may be prepared by any of the known processes described in the prior art and including those discussed hereinbefore.

An example of the general reaction scheme is shown in Scheme 1 set out below, where acetic acid is indicated as catalyst, resulting in the formation of the acetate salt. To carry out this scheme involves heating a mixture of vinyl pyridine and amine (preferably 1.05 equivalents), preferably for 2–8 hours at 90°–100° C. in the absence of any solvent. The addition of an extra equivalent of vinylpyridine results in the formation of a product in which $R^1$ represents a pyridylethyl group. Other acid catalysts and non-acid catalyst may also be used.

The scheme shows the preparation of a 2-substituted product, but by using an appropriate vinyl pyridine products with different substitution positions may be prepared.

SCHEME 1

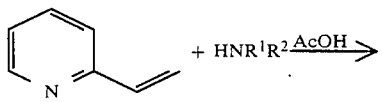

-continued

SCHEME 1

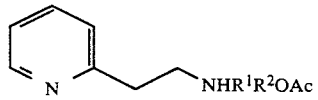

The general reaction shown in Scheme 1 is applicable to to reactions with both primary and secondary amines. Tertiary amines do not react to give quaternary salts. These compounds may be prepared, however, by quaternisation of the nitrogen by standard methods.

Acetamides may be formed from the acetate salts by loss of water—for example, under azeotropic distillation conditions. However, under standard conditions it is possible to halt the reaction at the acetate salt. Use of smaller amounts (e.g. 0.05 equivalents) or acetic acid catalyst results in the unsalified product.

The progress of the reaction may be easily monitored by thin layer chromatography, the reaction being judged to have terminated when traces of vinyl pyridine had disappeared.

Characterisation of the products was effected by $^1H$ nmr spectroscopy; infra red spectra were also obtained. Assignments were unambiguous. Table I provides data for a characteristic example.

TABLE I

'H nmr Assignments for N—Dodecyl 2-Aminoethyl Pyridine Acetate

| Chemical Shifts 5 ($CDCl_3$) | Assignment |
|---|---|
| 0.87 (3H, triplet) | alkyl $CH_3$ |
| 1.25 (20H, br. singlet) | alkyl $CH_3$ |
| 1.97 (3H, singlet) | acetate |
| 2.81–3.31 (6H, multiplet) | other $CH_2$ |
| 7.19–8.51 (6H, multiplet) | aromatic, $NH_2$ |

The following Examples are now given, though only by way of illustration, to show certain aspects of the invention in more detail.

EXAMPLES 1–18

Preparation of β-(2-pyridyl)-ethylamines

A number of β-(2-pyridyl)-ethylamines were prepared for testing according to the method of the invention. The following preparative technique was used.

An equivalent of 2-vinylpyridine, 1.05 equivalents of the appropriate amine and 1.0 equivalent of acetic acid were heated to 90°–100° C. for from 2 to 8 hours in the absence of any solvent. The product formed was an acetate salt of the formula:

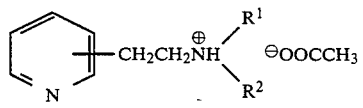

(III)

The results obtained (referring to general formula III) are set out in Table 2. The products were generally oils or waxes at room temperature.

TABLE 2

| Example | Amine | Product III $R^1$ | $R^2$ |
|---|---|---|---|
| 1 | $C_6H_{13}NH_2$ | $C_6H_{13}$ | H |
| 2 | $C_8H_{17}NH_2$ | $C_8H_{17}$ | H |
| 3 | $C_{10}H_{21}NH_2$ | $C_{10}H_{21}$ | H |
| 4 | $C_{12}H_{25}NH_2$ | $C_{12}H_{25}$ | H |

TABLE 2-continued

| Example | Amine | Product III $R^1$ | $R^2$ |
|---|---|---|---|
| 5 | $C_{14}H_{29}NH_2$ | $C_{14}H_{29}$ | H |
| 6 | $C_{16}H_{33}NH_2$ | $C_{16}H_{33}$ | H |
| 7 | $C_{18}H_{37}NH_2$ | $C_{18}H_{37}$ | H |
| 8 | benzylamine | $PhCH_2$ | H |
| 9 | cocoamine(1) | coco | H |
| 10 | cocodiamine(2) | coco-$NH(CH_2)_3$ | H |
| 11 | tallowamine(3) | tallow | H |
| 12 | tallowdiamine(4) | tallow-$NH_2$—$(CH_2)_3$ | H |
| 13 | ethylene-diamine | $NH_2(CH_2)_2$ | H |
| 14 | propylene-diamine | $NH_2(CH_2)_3$ | H |
| 15 | DETA(5) | $NH_2(CH_2)_2NH(CH_2)_2$ | H |
| 16 | TETA(6) | $NH_2(CH_2)_2NH(CH_2)_2NH(CH_2)_2$ | H |
| 17 | piperidine | $(CH_2)_5$ | |
| 18 | morpholine | $(CH_2)_2O(CH_2)_2$ | |

(1)a mixed long chain amine of average $C_{12}$ chain length derived from naturally occuring fatty acids.
(2)coco-NH—$(CH_2)_3$—$NH_2$
(3)a mixed long chain amine of average $C_{18}$ chain length derived from naturally occurring fatty acids.
(4)tallow-NH—$(CH_2)_3$—$NH_2$.
(5)diethylene triamine
(6)triethylene tetraamine

EXAMPLES 19 AND 20

Preparation of di-[β-(2-pyridyl)-ethyl]-amines

The procedure of Examples 4 and 8 was repeated using 2 equivalents of 2-vinylpyridines to form the corresponding tertiary amine having two pyridylethyl substituents, which were oils at room temperature. The results are given in Table 3.

TABLE 3

| Example | Amine | Product $R^1$ | $R^2$ |
|---|---|---|---|
| 19 | $C_{12}H_{25}NH_2$ | $C_{12}H_{25}$ | 2-pyridylethyl |
| 20 | benzylamine | $PhCH_2$ | 2-pyridylethyl |

EXAMPLE 21

Preparation of unsalified N-dodecyl-β-(2-pyridyl)-ethylamine

The procedure of Example 4 was repeated using 0.05 equivalents of acetic acid, and the unsalified N-dodecyl-β-(2-pyridyl)-ethylamine was formed, an oil at room temperature.

EXAMPLES 22–37

Preparation of β-(4-pyridyl)-ethylamines

The procedures of Examples 1–8, 10 and 12–18 was repeated replacing 2-vinylpyridine by 4-vinylpyridine and the corresponding β-(4-pyridyl)-ethylamines were produced. The results are given in Table 4. The products are generally oils or waxes at room temperature.

EXAMPLES 38 AND 39

Preparation of di-[β-(4-pyridyl)ethyl]-amines

The procedure of Examples 22 and 25 was repeated using 2 equivalents of 4-vinylpyridine to form the corresponding tertiary amines which were oils at room temperature. The results are given in Table 5.

TABLE 4

| Example | Amine | Product III $R^1$ | $R^2$ |
|---|---|---|---|
| 22 | $C_6H_{13}NH_2$ | $C_6H_{13}$ | H |
| 23 | $C_8H_{17}NH_2$ | $C_8H_{17}$ | H |
| 24 | $C_{10}H_{21}NH_2$ | $C_{10}H_{21}$ | H |
| 25 | $C_{12}H_{25}NH_2$ | $C_{12}H_{25}$ | H |
| 26 | $C_{14}H_{29}NH_2$ | $C_{14}H_{29}$ | H |
| 27 | $C_{16}H_{33}NH_2$ | $C_{16}H_{33}$ | H |
| 28 | $C_{18}H_{37}NH_2$ | $C_{18}H_{37}$ | H |
| 29 | benzylamine | $PhCH_2$ | H |
| 30 | cocodiamine | coco-$NH(CH_2)_3$ | H |
| 31 | tallowdiamine | tallow-$NH(CH_2)_3$ | H |
| 32 | ethylene-diamine | $NH_2(CH_2)_2$ | H |
| 33 | propylene-diamine | $NH_2(CH_2)_3$ | H |
| 34 | DETA | $NH_2(CH_2)_2NH(CH_2)_2$ | H |
| 35 | TETA | $NH_2(CH_2)_2NH(CH_2)_2NH(CH_2)_2$ | H |
| 36 | piperidine | $(CH_2)_5$ | |
| 37 | morpholine | $(CH_2)_2O(CH_2)_2$ | |

TABLE 5

| Example | Amine | Product (III) $R^1$ | $R^2$ |
|---|---|---|---|
| 38 | $C_6H_{13}NH_2$ | $C_6H_{13}$ | 4-pyridylethyl |
| 39 | $C_{12}H_{25}NH_2$ | $C_{12}H_{25}$ | 4-pyridylethyl |

The products of the Examples were subjected to a solubility test, an emulsion test, several corrosion inhibition tests and a film persistency corrosion test.

A. Solubility Test

The active material under test was made up into a 35 wt% solution in isopropylalcohol (IPA). 0.3 ml of this solution was shaken with 10 ml of each of the liquids in which solubility is to be tested: water, 5 wt% NaCl solution (brine) and heptane. The mixture was observed after 30 minutes and 24 hours. The results for the products of Examples 1 through 35 are given in Table 6.

B. Emulsion Test 1 ml of the solutions used for Test A was shaken with 50 ml of 3 wt% brine and 50 ml of heptane for 1 minute in a 150 ml bottle. The emulsion was observed, and the time noted for the emulsion to break and form a clean interface with clear liquid layers. If at 30 minutes this had not occurred, the appearance was recorded together with the thickness of any persisting emulsion. The results for the products of Examples 1 through 39 are given in Table 7.

TABLE 6

| EXAMPLE | SOLUBILITY IN: Water | Brine | Heptane |
|---|---|---|---|
| 1 | S | S | S |
| 2 | D | D | S |
| 3 | S | D | S |
| 4 | S | D | S |
| 5 | S | IS | S |
| 6 | S | IS | S |
| 7 | S | IS | S |
| 8 | S | D | S |
| 9 | S | IS | S |
| 10 | S | D | S |
| 11 | S | IS | S |
| 12 | S | IS | S |
| 13 | S | S | S |
| 14 | S | S | S |
| 15 | S | S | D |
| 16 | S | S | S/D |
| 19 | S | D | S |

TABLE 6-continued

| EXAMPLE | SOLUBILITY IN: Water | Brine | Heptane |
|---|---|---|---|
| 20 | S | D | S |
| 22 | S | S | S |
| 23 | S | D | S |
| 24 | S | D | S |
| 25 | S | D | S |
| 26 | S | IS | S |
| 27 | S | IS | S |
| 28 | S | IS | D |
| 29 | D | D | D |
| 30 | S | D | S |
| 31 | S | IS | D |
| 32 | D | D | D |
| 33 | S | S | IS |
| 34 | S | S | IS |
| 35 | S | S | IS |

S = soluble
IS = insoluble
D = dispersible

TABLE 7

| Product of Example | Time to break emulsion (mins) | Appearance after 30 mins water/hydrocarbon | Emulsion thickness after 30 mins |
|---|---|---|---|
| 1 | 30 | clear/clear | — |
| 2 | 5 | clear/clear | — |
| 3 | >30 | hazy/hazy | — |
| 4 | >30 | hazy/hazy | — |
| 5 | >30 | hazy/hazy | 0.5 |
| 6 | >30 | hazy/hazy | 1.0 |
| 7 | >30 | clear/emulsified | |
| 8 | >30 | hazy/clear | — |
| 9 | >30 | hazy/clear | — |
| 10 | >30 | hazy/clear | 3.0 |
| 11 | >30 | emulsified/clear | 4.5 |
| 12 | >30 | hazy/hazy | 0.2 |
| 13 | >30 | hazy/clear | — |
| 14 | >30 | hazy/clear | — |
| 15 | 10 | clear/clear | — |
| 16 | 10 | clear/clear | — |
| 19 | >30 | hazy/hazy | — |
| 20 | 1 | clear/clear | — |
| 22 | 1 | clear/clear | — |
| 23 | 10 | clear/clear | — |
| 24 | >30 | hazy/hazy | — |
| 25 | >30 | hazy/hazy | 0.2 |
| 26 | >30 | hazy/clear | 1.0 |
| 27 | >30 | hazy/clear | 3.0 |
| 28 | >30 | clear/hazy | 4.0 |
| 29 | 1 | clear/clear | — |
| 30 | >30 | hazy/hazy | 0.5 |
| 31 | >30 | clear/emulsified | 4.0 |
| 32 | >30 | hazy/clear | — |
| 33 | 1 | clear/clear | — |
| 34 | 1 | clear/clear | — |
| 35 | 1 | clear/clear | — |
| 38 | 1 | clear/clear | — |
| 39 | >30 | hazy/hazy | 0.1 |

C. Corrosion Inhibition

Test Method

For each compound three mild steel coupons (approximately 100 mm×12 mm×1.5 mm) were tested at each concentration. Each was contacted in a 250 ml bottle with 200 ml of a test fluid either saturated with a carbon dioxide at 20° C. or containing 100 ppm hydrogen sulphide or having both $CO_2$ and $H_2S$ present in those amounts. The test fluid was treated with a 30% aqueous solution of the compound under test at 2, 10, 50 and 250 ppm except where indicated to the contrary. The coupon was subjected to a dynamic wheel test in which the bottle was mounted radially on the periphery of 650 mm diameter wheel which was rotated at about 40 rpm for 24 hours at 70° C. The weight loss was obtained, and also measured in a control experiment where no inhibitor was present. From this the % protection was calculated as % reduction in weight loss.

Corrosion Test 1

Test fluid: 100 ml 3 wt% brine/100 ml Mentor 28 (Mentor ®28 is a depolarised kerosene available from Exxon Chemical Company)

Corrosives: Saturated $CO_2$+100 ppm $H_2S$

Results are given in Table 8 below.

TABLE 8

| Product of Example | % Protection @ (ppm) 2 | 10 | 50 | 250 |
|---|---|---|---|---|
| 1 | 15 | 73 | 79 | 91 |
| 2* | 50 | 82 | 85 | 89 |
| 3 | 13 | 63 | 82 | 99 |
| 4 | 21 | 73 | 93 | 94 |
| 5 | 0 | 43 | 46 | 90 |
| 6 | 7 | 72 | 89 | 98 |
| 7 | 13 | 52 | 87 | 95 |
| 8 | 21 | 72 | 81 | 81 |
| 8* | 46 | 53 | 88 | 97 |
| 9* | 54 | 81 | 94 | 98 |
| 10 | 27 | 83 | 95 | 97 |
| 11* | 61 | 87 | 96 | 98 |
| 12* | 85 | 95 | 97 | 98 |
| 13* | 43 | 67 | 82 | 92 |
| 14* | 47 | 70 | 70 | 92 |
| 15 | 32 | 72 | 80 | 87 |
| 16 | 32 | 72 | 81 | 89 |
| 19 | 16 | 71 | 77 | 86 |
| 20 | 24 | 25 | 63 | 81 |
| 21 | 17 | 51 | 86 | 93 |
| 21 acetate salt | 21 | 74 | 94 | 96 |
| 2-aminoethyl pyridine | 0 | 45 | 55 | 86 |
| 22 | 41 | 67 | 81 | 87 |
| 23 | 38 | 49 | 83 | 92 |
| 24 | 58 | 80 | 88 | 95 |
| 25 | 28 | 53 | 88 | 96 |
| 27 | 39 | 69 | 84 | 96 |
| 28 | 8 | 23 | 48 | 87 |
| 29 | 25 | 56 | 60 | 67 |
| 30 | 51 | 66 | 78 | 84 |
| 31 | 53 | 56 | 76 | 81 |
| 34 | 22 | 50 | 66 | 80 |
| 38 | 2 | 64 | 79 | 80 |
| 39 | 26 | 70 | 89 | 89 |
| 2-ethylpyridine | 3 | 7 | 16 | 23 |
| 2-ethylpyridine.HCL | 10 | 10 | 24 | 18 |
| 4-ethylpyridine.HCL | 2 | 5 | 13 | 16 |
| Alkyl pyridines(1) | 27 | 36 | 38 | 48 |
| Alkyl pyridines(2) | 16 | 32 | 45 | 47 |

* = active material added as undiluted compound rather than 30% IPA solution.
(1)commercially available (from Reilly Tar & Chemical Co.) mixed alkyl pyridines with $C_2$–$C_7$ alkyl groups, the major component being a $C_4$ derivative.
(2)Hydrochloric acid salt of(1).

Corrosion Test 2

Test Fluid: 200 ml 3 wt% brine

Corrosives: Saturated $CO_2$+100 ppm $H_2S$

Results are given in Table 9 below.

TABLE 9

| Product of Example | % Protection @ (ppm) 2 | 10 | 50 | 250 |
|---|---|---|---|---|
| 1 | 13 | 57 | 83 | 93 |
| 2 | 37 | 34 | 84 | 94 |
| 3 | 7 | 37 | 91 | 97 |
| 4 | 24 | 94 | 95 | 96 |
| 5 | 3 | 48 | 93 | 94 |
| 6 | 20 | 41 | 93 | 97 |
| 7 | 81 | 89 | 99 | 99 |

TABLE 9-continued

| Product of Example | % Protection @ (ppm) 2 | 10 | 50 | 250 |
|---|---|---|---|---|
| 8 | 37 | 69 | 75 | 85 |
| 9 | 24 | 77 | 94 | 97 |
| 10 | 88 | 97 | 99 | 100 |
| 11 | 12 | 47 | 74 | 83 |
| 12 | 6 | 38 | 80 | 81 |
| 13 | 40 | 42 | 74 | 89 |
| 14 | 26 | 64 | 74 | 90 |
| 15 | 22 | 63 | 81 | 87 |
| 16 | 37 | 59 | 81 | 89 |
| 20 | 51 | 63 | 75 | 91 |
| 22 | 11 | 9 | 41 | 74 |
| 25 | 5 | 44 | 79 | 94 |
| 27 | 40 | 47 | 84 | 94 |
| 28 | 11 | 94 | 96 | 95 |
| 31 | 7 | 47 | 95 | 95 |
| 34 | 18 | 26 | 48 | 69 |
| 39 | 41 | 65 | 78 | 87 |

Corrosion Test 3

Test fluid: 100 ml 3 wt% brine+100 ml Mentor 28

Corrosives: Saturated $CO_2$ only

Results are set out in Table 10 below.

TABLE 10

| Product of Example | % Protection @ (ppm) 2 | 10 | 50 | 250 |
|---|---|---|---|---|
| 4 | 0 | 0 | 7 | 61 |
| 7 | 2 | 22 | 48 | 67 |
| 8 | 13 | 32 | 34 | 37 |
| 9 | 0 | 15 | 36 | 58 |
| 10 | 60 | 79 | 100 | 100 |
| 11 | 9 | 68 | 74 | 79 |
| 12 | 37 | 42 | 44 | 96 |
| 13 | 0 | 10 | 19 | 23 |
| 22 | 9 | 5 | 13 | 7 |
| 25 | 10 | 6 | 21 | 27 |
| 28 | 8 | 12 | — | 9 |
| 31 | 12 | 22 | 12 | 73 |
| 34 | 6 | 11 | 13 | 18 |
| 39 | 9 | 5 | — | 15 |

Corrosion Test 4

Test fluid: 100 ml 3 wt% brine+100 ml Mentor 28

Corrosives: 100 ppm $H_2S$ (prior nitrogen purge)

Results are given in Table 11 below.

TABLE 11

| Product of Example | % Protection @ (ppm) 2 | 10 | 50 | 250 |
|---|---|---|---|---|
| 1 | 0 | 22 | 55 | 55 |
| 3 | 0 | 42 | 65 | 76 |
| 4 | 20 | 42 | 50 | 66 |
| 6 | 0 | 21 | 58 | 70 |
| 8 | 8 | 12 | 40 | 55 |
| 9 | 0 | 7 | 80 | 90 |
| 10 | 5 | 55 | 65 | 81 |
| 11 | 38 | 50 | 73 | 81 |
| 12 | 15 | 60 | 82 | 80 |
| 13 | — | 40 | — | 57 |
| 16 | 10 | 48 | 56 | 61 |
| 19 | 2 | 57 | — | 57 |
| 22 | 8 | 50 | 67 | 67 |
| 25 | 11 | 17 | 57 | 78 |
| 28 | 2 | 3 | 49 | 56 |
| 31 | 29 | 72 | 81 | 84 |
| 34 | 20 | 45 | 62 | 67 |
| 39 | 3 | 26 | 64 | 85 |

D. Film persitency corrosion test

A film persistency corrosion test was carried out for each compound at concentrations of 500, 1000 and 3000 ppm, with in each case three tests being carried. A test fluid made up of equal proportions of 3 wt% brine and Mentor 28 was used, saturated with $CO_2$ and containing 100 ppm $H_2S$ as corrosives. Coupons were used as described for the previous corrosion test. A coupon was first immersed in test fluid containing corrosives and the inhibitor under test for 1 hour, then rinsed for 1 hour in a similar test fluid containing no inhibitor and finally transferred to a further test fluid again containing no inhibitor in which the dynamic wheel test was carried out at 70° C. for 24 hours.

The results are given in Table 12.

TABLE 12

| Product of Example | % Protection @ (ppm) | | |
|---|---|---|---|
| | 500 | 1000 | 5000 |
| 1 | 18 | 25 | 17 |
| 4 | 14 | 14 | 14 |
| 7 | 13 | 10 | 19 |
| 8 | 19 | 22 | 24 |
| 10 | 19 | 18 | 17 |
| 11 | 5 | 10 | 24 |
| 15 | 13 | 11 | 17 |
| 22 | 19 | 20 | 23 |
| 25 | 17 | 15 | 20 |
| 28 | 16 | 16 | 23 |
| 30 | 25 | 26 | 26 |
| 35 | 19 | 18 | 20 |
| 39 | 20 | 24 | 33 |

The majority of compounds tested in the above tests were prepared as acetate salts, with one mole of acetic acid per mole of vinyl pyridine, but free nitrogen groups will be present in all samples. Acetic acid was used as a catalyst and therefore the preparation can be carried out in the presence of less than stoichiometric quantities resulting in the free basic product as in Example 21. The products of Example 21 showed inferior corrosion protection to Example 4, but addition of acetic acid to Example 21 gave substantially identical protection to that seen in Example 4.

Examples 19, 20, 38 and 39 show the effect of using 2 equivalents of vinyl pyridine to yield a tertiary amine 2:1 adduct. In the test, these 2:1 derivatives tended to perform less well than 1:1 derivatives in constant concentration conditions. It may be expected that this higher molecular weight inhibitor would provide a more persistent film; this is observed in Test D.

In general, the corrosion tests show that a better performance is obtained at higher chain lengths for the amine substituent. Increasing the number of nitrogen donor atoms is also a desirable factor; however, the long alkyl chain is still desirable in order to achieve peak performance. The desirability of this configuration is displayed by the long chain alkyl propylene diamines derivatives of Examples 10, 12 and 30.

In Corrosion Test 1, a longer chain length imparts some increase in performance, with diamines showing a better performance at low concentrations. 2-vinyl pyridine derivatives show generally slightly superior to 4-vinyl pyridine derivatives. The advantage of the aminoethyl pyridine derivatives over alkyl pyridines is demonstrated in Corrosion Test 1.

Performance in Corrosion Test 2 (simulating waterflood conditions) was similar to Test 1 (mixed hydrocarbon/water systems), with 2-vinyl pyridines showing better corrosion protection figures than 4-derivatives. Excellent properties are displayed in particular by alkyl diamine derivatives in this test.

In Corrosion Test 3 the long chain diamine derivatives display significantly better performances. It has generally been found that more basic compounds (free amine groups) will protect against sour corrosion, whereas more acidic compounds are better against the sweet corrosion conditions of this test. These results were in agreement with this generalisation.

In Corrosion Test 4 ($H_2S$ corrosion only) performance of the compounds tested followed the trends of Tests 1 and 2.

In film persistency tests none of the inhibitors tested provided protection above 33% at 3000 ppm. Performance under these conditions may be improved, however, by salting of the amine groups with high molecular weight acids such as tall oil fatty acid or dimerised/-trimerised fatty acids.

Test A showed that many of these inhibitors tested are soluble in hydrocarbon and distilled water, but insoluble or dispersible in 5% brine. The polyamine derivatives, due to high polarity, are also brine soluble. However, by ethoxylation, quaternisation or salt formation it would be possible to obtain appropriate solubility properties for a particular application.

We claim:

1. A method of inhibiting corrosion of metals, which method comprises treating a metal containing system where metals are susceptible to corrosion with a corrosion-inhibiting amount ranges from 1 to 10,000 ppm (by weight) of the fluid within the system of a substituted β-pyridylethylamine or a salt thereof of the general formula:

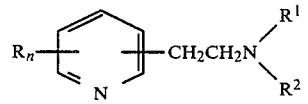

(I)

wherein R is an alkyl, aryl, aralkyl, alkaryl, halo or amino group or a group —COX where X is hydrogen, alkyl, aryl, hydroxy, alkoxy, aryloxy, amino or halo group, n is zero or an integer from 1 to 4, and $R^1$ and $R_2$, which may be the same or different, each represent a hydrogen atom, an optionally substituted hydrocarbyl radical, an alkylamino radical, a heterocyclic radical or a group

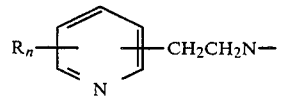

or R1 and R2 with the intervening nitrogen atom together represent a saturated or unsaturated heterocyclic ring optionally containing one or more additional heteroatoms.

2. The method of claim 1, in which the β-pyridylethylamine is a compound of the general formula:

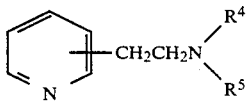

(II)

(wherein $R^4$ and $R^5$, which may be the same or different, each represent a hydrogen atom (provided that both $R^4$ and $R^5$ do not represent hydrogen) a straight or branched chain alkyl group containing from 1 to 22 carbon atoms, a benzyl group or an alkylamino group $—(A—NH)_m—R^3$, or $R^4$, $R^5$ and the intervening nitrogen atom to which they are bonded together for a piperidine, morpholine, pyridine or pyrrole radical) and salts thereof.

3. The method of claim 2, wherein said compound is a 2- or 4-substituted pyridine.

4. The method of claim 4 wherein $R^4$ represents hydrogen or a group

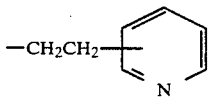

and $R^5$ represents a benzyl group or a straight chain alkyl group having from 12 to 18 carbon atoms.

5. The method of claim 3 wherein $R^4$ represents hydrogen, $R^5$ represents a group $—A—NH—R^3$ and $R^3$ represents a straight chain alkyl group having from 12 to 18 carbon atoms.

6. The method of claim 3 in which $R^4$ represents hydrogen and $R^5$ represents $(ANH)_mH$ and m is 2 or 3.

7. The method of claim 1 wherein said $\beta$-pyridylethylamine is employed in the form of a salt with hydrochloric acid, acetic acid, propionic acid or a long chain fatty acid.

8. The method of claim 1 wherein said $\beta$-pyridylethylamine is introduced into the system with a suitable vehicle.

* * * * *